US005546875A

United States Patent [19]

Selle et al.

[11] Patent Number: 5,546,875

[45] Date of Patent: Aug. 20, 1996

[54] CONTROLLED SPONTANEOUS REACTOR SYSTEM

[75] Inventors: Stanley J. Selle, East Grand Forks, Minn.; Douglas R. Hajicek, Grand Forks, N. Dak.; Michael D. Mann, Thompson, N. Dak.; Nanak S. Grewal, Grand Forks, N. Dak.

[73] Assignee: Energy and Environmental Research Center Foundation, Grand Forks, N. Dak.

[21] Appl. No.: 341,742

[22] Filed: Nov. 18, 1994

Related U.S. Application Data

[63] Continuation-in-part of Ser. No. 113,451, Aug. 27, 1993, abandoned.

[51] Int. Cl.[6] ..... F23B 7/00

[52] U.S. Cl. ..... 110/342; 110/245; 432/14; 432/58

[58] Field of Search ..... 110/224, 225, 110/229, 244, 245, 342, 347, 348; 34/364, 370, 579, 589; 432/14, 58

[56] References Cited

U.S. PATENT DOCUMENTS

| | | | |
|---|---|---|---|
| 2,419,245 | 4/1947 | Arveson | 34/589 X |
| 3,671,402 | 6/1972 | Wenzel et al. | 201/15 |
| 4,324,544 | 4/1982 | Blake | 432/14 |
| 4,325,311 | 4/1982 | Beranek et al. | 110/245 |
| 4,349,969 | 9/1982 | Stewart et al. | 34/579 |
| 4,645,452 | 2/1987 | Henin et al. | 110/245 X |
| 4,725,337 | 2/1988 | Greene | 201/29 |
| 4,809,620 | 3/1989 | Cosar | 110/245 |
| 5,009,173 | 4/1991 | Temelli | 110/245 |
| 5,020,456 | 6/1991 | Khinkis | 110/245 |
| 5,069,171 | 12/1991 | Hansen | 122/4 D |
| 5,078,065 | 1/1992 | Tsunemi | 110/245 |
| 5,087,269 | 2/1992 | Cha et al. | 44/626 |
| 5,095,827 | 3/1992 | Williams | 110/234 |
| 5,242,662 | 9/1993 | Toth | 422/142 |

*Primary Examiner*—Henry A. Bennett
*Assistant Examiner*—Susanne C. Tinker
*Attorney, Agent, or Firm*—Zarley, McKee, Thomte, Voorhees & Sease

[57] ABSTRACT

A process of improving overall quality of coals or other solid fuels comprising heat treating those coals in a controlled, spontaneous, fluidized bed reactor system. The bed system is of such a geometry that in combination with the control system a higher velocity region exists where the fluidizing gas and fuel are fed than where the treated solids exit. The offgas exiting the top of the reactor has a velocity of the average of the inlet gas velocities. Treated coal is withdrawn intermediate to top and bottom. Residence time is controlled by the amount of the solid fuel feed, the location of the treated solid fuel overflow, and the temperature is maintained by oxygen to flue gas ratio, feedstock size and fluidizing velocity. The unit can be operated in a drying mode or a devolatilization mode, to control volatiles, moisture and fines.

19 Claims, 3 Drawing Sheets

MEASURED VALUES
— PREDICTED VALUES

CONTROLLED SPONTANEOUS REACTOR SYSTEM

GRANT REFERENCE

This invention was made with Government support under cooperative agreement No. DE-FC21-86MC 10637 awarded by DOE. The government has certain rights in this invention.

CROSS-REFERENCE TO A RELATED APPLICATION

This application is a continuation-in-part of Ser. No. 08/113,451 filed Aug. 27, 1993, now abandoned.

BACKGROUND OF THE INVENTION

The present invention relates to a controlled, spontaneous reactor system which can be used for successfully treating coals and other solid fuels to make those fuels competitive with lower moisture, higher Btu rated coals. This invention is applicable not only to U.S. coals, but coals from Canada and throughout the world.

Subbituminous and lignitic coals typically found in the Western portions of the United States have higher moisture contents than Eastern bituminous coals. This results in lower rated efficiency, and in some cases, increased polluting effect. As a result, by way of example only, boilers designed and rated for certain performances will be derated or perform at lower levels of efficiency when fed high moisture, low-rank coal. This problem of derating substantially reduces a potentially available market for Western low-rank coals.

It is generally known in the art that some of the problems for low-rank coals can be overcome by treating such coals in fluidized bed reactors. Thus, for example, drying of low-rank coals in fluidized bed reactors prior to shipment in order to have a decreased freight rate, is known. So too is drying in an effort to increase overall boiler system efficiency. However, in the past such dryers have been built with single special uses in mind, and require specific drying processes, temperatures, conditions, dryer geometry, coal sizing, etc., all depending upon the nature of the use and the overall objective of the treatment process. These types of dryers have the disadvantage of producing a high degree of fines and/or a product that will spontaneously combust uncontrollably upon storage or shipment. This requires special treatment of the coal prior to shipment. They also require coal sizing within tight tolerances to operate correctly. A relatively high gas temperature is also required for typical thermal dryers. These factors result in high operating costs and a large amount of coal fines that are difficult to use or sell.

It can therefore be seen that there is a real and continuing need for an overall treatment reactor that can provide a generalized method of treating coal to realize a reduction in overall capital and operating costs, limit the amount of presizing of the coal, to increase boiler system efficiency and overall efficiency, and to reduce emission levels for steam or power production.

Passage of the Clean Air Act Amendments of 1990 has drastically changed the strategies that a utility must use to comply with federal emission standards. A number of different technologies have been developed for $NO_x$ control in cyclone boilers; including selective catalytic and noncatalytic reduction (SCR and SNCR), reburning, and slagging combustors. SCR, SNCR, and slagging combustors are expensive to install. Reburning appears to be the most attractive $NO_x$ control method. Reburning using natural gas as the reburn fuel has been demonstrated at Ohio Edison' Niles plant, while micronized coal has been demonstrated as a reburn fuel by Wisconsin P&L in their Nelson Dewey plant. Although both of these plants demonstrated that reburn was a successful method of reducing $NO_x$ emissions in a cyclone unit, these methods are not preferred by most utilities due either to the unavailability of gas at the plant site, or the inherent safety problems associated with handling the micronized coal that is used for reburning. Therefore, there is a need for another inexpensive source of reburn fuel that can be used to control $NO_x$ in cyclone boilers.

Another objective of the present invention is to provide a controlled, spontaneous, fluidized bed reactor, which can be operated as required to eliminate derates, to reduce $NO_x$ and fouling for low-rank coals used in cyclone boilers, for generalized coal drying, to extend the load control range and to reduce $NO_x$ and $N_2O$ emissions for fluidized bed combustion, and for char production from coal.

The method and manner of accomplishing each of the above objectives will become apparent from the detailed description of the invention which follows.

BRIEF DESCRIPTION OF THE DRAWINGS

FIG. 2 shows % moisture removed and the top-of-bed temperature, FIG. 3 shows the relationship between volatiles removed and operating conditions, FIG. 4 shows mass balance for a devolatilization test and FIG. 5 shows energy balance for a devolatilization test.

SUMMARY OF THE INVENTION

Figure 1:
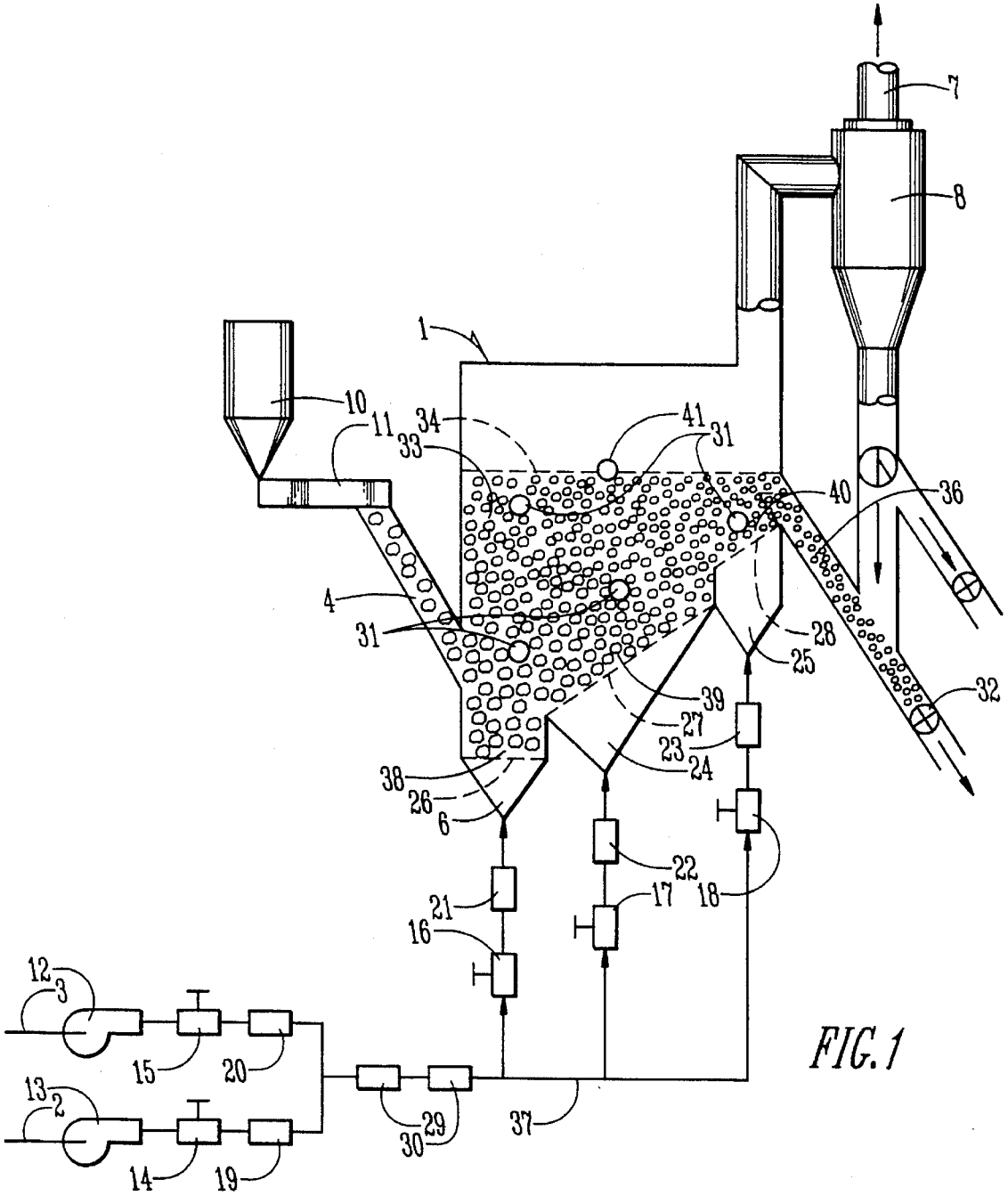
FIG. 1 is a schematic of the controlled, spontaneous reactor system.

A process of improving overall quality of coals or other solid fuels, comprising heat treating those fuels in a controlled, spontaneous, fluidized bed reactor system. Spontaneous is defined for this system as having the ability to generate the heat necessary to control the process internal to the system with no external heat provided.

The bed geometry design used in conjunction with the control system allows fluidization of large size solid fuel particles in the reactor. The feedstock may be introduced above the fluidized bed, or alternatively into an intermediate point within the fluidized bed. Fluidizing zones in the reactor can be considered to be vertically oriented for description purposes even though there is horizontal blending of gases as they move up through the bed. In order to ensure proper fluidization of the largest feedstock particles, the lowest and deepest bed zone has the highest fluidizing gas velocity. Conversely, the upper bed zone has the lowest fluidizing gas velocity to allow retention of the proper product particle size just prior to its withdrawal from the bed. The bottom bed geometry can be physically altered to optimize specific operating velocities in each bed zone appropriate to the multiple particle size ranges that will be present in the reactor to allow precise control of the size and properties of the product required. The gas velocity exiting the top of all the fluidized bed zones will be at a velocity average to all of those zones. The withdrawal point for the solid treated fuel is at the top of the bed or at an intermediate location, depending upon the desired properties of the treated fuel. A control valve 32 may be used to control the product removal rate when an intermediate location is used. Residence time and treated fuel product size are controlled by the rate of the fuel feed, the location of the treated fuel overflow and operation of a product removal rate control valve, if required. The temperature is maintained by oxygen-to-fuel ratio, fuel feed rate and fluidizing velocity. The oxygen is supplied by a combination of the fluidizing gas and outside air. The unit can be operated in a drying mode or a devolatilization mode to remove and control volatiles, moisture and fines.

In the process of the present invention, the general flow and velocity is from the bottom lower left of the reaction zone to the upper right of the reaction zone with fluidizing gas velocity decreasing as the fluidized solid material migrates up through the bed as its physical size decreases. Overall feedstock reduction is a result of the combination of thermal liberation of moisture and the physical action of the bed. The operating parameters that can be used to control the amount of drying and/or devolatilization and product characteristics include fluidizing gas flow rate, air flow rate, fuel feed rate, and inlet gas temperature. Combustion is spontaneous in the reactor.

The fluidized bed itself is well understood and not the subject of this patent. The specific process of controlled spontaneous reaction in this type of system is novel and described in the following detailed description. The ability to feed large sized fuel with a wide size distribution and have this fuel reduced in size and segregated is also a novel feature.

DETAILED DESCRIPTION OF THE INVENTION

A schematic of the invention is illustrated in FIG. 1. Basically, the geometry of the controlled spontaneous reactor 1 is designed so that solids flow through the reactor 1 will generally be from the bottom left at a high velocity and pressure to a lower pressure and velocity at the upper right. The controlled spontaneous reactor is operated as a fluidized bed. The reactor has a smaller cross-sectional area on the bottom left of the bed 38 than on the top of the bed 34. This geometry coupled with variable velocities directly above each distribution plate results in a higher velocity at the bottom left of the bed than at the overall top of the bed 34.

The fluidizing gas 37 is made up of air 3 and flue gas or other waste gases 2. The flow of the two gases are controlled by dampers or other flow control devices (14 and 15). The quantity of gas from each monitored with a flow meter (19 and 20), such as an anubar or orifice. The combined stream is monitored for temperature 30 and oxygen content 29. Blowers 12 and 13 move the gases and provide the necessary pressure. The quantities of air 3 and flue gas or other waste gas 2 are varied to obtain the desired oxygen content in the combined stream. The total combined gas volume is controlled to give the desired volume of fluidization gases to the controlled spontaneous reactor.

The bottom of the controlled spontaneous reactor is divided into two or more separate plenums 6, 24 and 25, for delivery of the fluidization gas (three plenums are used for this illustration). The inlet to each plenum has flow control 16, 17 and 18 and flow monitoring 21, 22 and 23. The flow to each plenum is adjusted to give the desired local velocity to the bed. The gas distribution plates for each section 26, 27 and 28 provide a pressure drop to ensure even distribution of the fluidizing gas from each plenum into the reactor.

The bed of fluidized fuel 33 purposely does not have any divisions between the three sections. The velocity distribution and bottom designs are such that directly above the distribution plates the local velocity in each region of the lower bed will be determined by the quantity of gas supplied to that plenum. After leaving the immediate area of the controlled local gas velocities (38, 39, 40) above each separate plenum (6, 24, 25) the gas streams merge and the effective bed fluidizing gas velocity becomes an average velocity based on the total gas supplied to the bed. For example, suppose the area ratios of first, second, and third plenums are 1:3:1 and the local velocity directly above the respective plenums are 20, 10 and 5 ft/sec. Theoretically, at the top of the bed the average velocity would be $(1\times20+3\times10+1\times5)/(1+3+1)=11$ ft/sec.

The ratios of the areas of the plenums are set during the design. The plenum is split into two or more sections to provide a velocity profile within the bed that allows for the capability to classify the fuel by particle size and weight. A high velocity region exists at the bottom of the bed directly above the first plenum 6. This high velocity region ensures that the largest heaviest particles in the feedstock will remain in a state of motion (fluidized). The velocity decreases as one moves higher in the bed and as one moves directly above the second and third plenums 24 and 25. No large fuel particles can move to the solids exit 36 because a size reduction must occur for a particle to be fluidized in the low velocity region at the top right of the bed and near the controlled spontaneous reactor outlet. Additionally, particles decrease in weight due to removal of moisture and the removal of volatiles at higher operating temperatures. This size and weight reduction occurs by a combination of the physical action of the bed and the inherent nature of the fuels to breakup upon heating and drying. The ability to classify the fuel is an important and unique feature of the controlled spontaneous reactor of this invention.

Fuel can be fed into the system at any height. In the schematic of FIG. 1, the fuel is delivered from a bunker 10 and is metered by use of a weigh belt feeder or other metering device 11 and fed into the controlled spontaneous reactor through fuel delivery tube 4. Here it is shown being fed into the body of the bed. It can also be delivered onto the top of the bed from above the bed. Fuel particles are removed from solids exit 36. When located at top-of-bed 34 the solids exit 36 simply operates as an overflow and the product exit valve 32 serves as a pressure isolation device. Solids residence time is then controlled only by the fuel feed rate. When solids are removed at an intermediate location in the bed, product exit valve 32 is additionally required to operate as a control device and is used to control solids residence time in conjunction with the fuel feed rate.

The control logic, sensors and control mechanisms are relatively simple. The fluidizing gas flow required from the first plenum section 6 is determined by the top size of the fuel being fed into the unit. The fluidizing gas flow must be adequate to fluidize the largest fuel particles. The largest size fuel particle will be determined by the existing fuel preparation facilities at the end users site. The velocity will be adjusted using flow control/damper 16 and monitored with flow monitor 21. The overall average gas fluidizing velocity at the top of the bed 34 is important for determining the final size of the product. Lower average velocities are required if a smaller product size is desired. The average velocity is controlled using flow controllers 14 and 15 and monitored with flow monitors 19 and 20.

In operation, fuel is spontaneously combusted in the fluid bed to provide the heat required to dry or devolatilize the fuel. It has been noted that fuel that is piled on the ground or stored in bunkers will combine with oxygen and "self heat", provided there are natural convection currents that bring in fresh oxygen and remove the products of combustion. When this occurs in an uncontrolled fashion, all of the fuel can be consumed. The temperature of the fuel will increase as a function of the oxygen availability. The basis for the controlled spontaneous reactor operation is to control the oxygen being supplied to the fuel so that only a portion of the fuel will burn. The internal heat production and the amount of fuel that is consumed are controlled by the amount of oxygen supplied. Oxygen supply control is achieved by varying the ratio of the air 3 to flue gas or other waste gas 2. The flue gas or other waste gas 2 is used to further dilute the oxygen in the air stream 3 (21% oxygen) to a lower value. The oxygen level in the combined stream is measured with an oxygen sensor 29. The amount of drying or devolatilization is a function of temperature. Therefore, the operating temperature of the fluidized fuel bed 33 will be monitored with multiple temperature sensors 31. The number and location will vary with the size of the reactor. The top-of-bed temperature 41 will be used as feed back to vary the quantities of air 3 delivered relative to flue gas or other waste gas 2. If the temperature is too high, the control loop will close down the air flow controller 15 to reduce the total amount of oxygen. If the temperature is too cool, more air will be fed into the controlled spontaneous reactor. Flow controller 14 will adjust itself to maintain a constant total gas volume to the controlled spontaneous reactor. Because of its ability to generate its own heat, an external boiler or other heat source is not needed to keep the process going. External heat is a necessity only to expedite start-up of the unit. For certain applications the controlled spontaneous reactor can be located next to an existing boiler or other source of flue gases.

Throughout this description, a number of different possibilities have been given for devices such as those to meter the solids or control gas flows. For cases such as this, it is critical that these streams be controlled, but the method for controlling or monitoring is not. It was written to leave these as choices because some end users may prefer weigh belts to feed fuel, while another user may prefer a rotary feeder. The best choice of feed systems may also vary depending upon the design throughput of the unit for the particular customer. The same is true for the other items that are listed generically or a choice of several options is given.

The fluidizing gas velocity at the bottom of the bed 38 is a function of the type of fuel used and the top size of the feedstock fuel. The local fluidizing gas velocity in this region 38 and in regions 39 and 40 will vary from 1 to 5 times the minimum fluidization gas velocity of the largest fuel particles resident within each of these zones. The fluidizing gas velocity at the top of the bed 34 will vary with the desired size of the product and can range from 3 to 25 feet per second.

Initial start-up of the unit can be accomplished by using cool flue gases (approximately 300° F.) or other gases having a minimal amount of oxygen. Air is added to obtain a prescribed oxygen-to-fuel ratio. This ratio is a function of the type of fuel, and the residence time used. Once the bed has reached the desired operating temperature, the temperature in the bed is controlled by varying the oxygen-to-fuel ratio, the fluidizing gas velocity, and the total fluidizing gas-to-fuel ratio. Proper control of the temperature in combination with velocity, oxygen-to-fuel ratio, and residence time allows the desired product quality to be obtained. Product quality is defined by the end user, and includes moisture and volatiles level, and size distribution of the over flow char, the amount and size of the fines, and the amount and quality of the product gas.

Although the controlled spontaneous reactor can be operated anywhere in a continuous temperature regime from about 100° F. to 1300° F., its typical operation would be either in a drying regime or in a devolatilization regime. To obtain the optimal product (dried fuel) in the drying regime, the controlled spontaneous reactor is operated at a top bed temperature 41 ranging from 100° F. to 180° F. A significant level of drying is achieved at these low temperatures which results in a minimum amount of fines and reduced chance of uncontrolled spontaneous combustion as the product is stored and handled. These factors, plus the ability to utilize larger sized feedstocks, are salient features that differentiate the controlled spontaneous reactor from other thermal dryers. In the drying mode of operation, the relatively low top-of-bed temperature can be maintained either by using a fluidizing gas made up of flue gas or waste gas at approximating 250° F. to 350° F. or by generating heat internally by adding minimal amounts of oxygen to a gas stream at ambient temperature. The dried product is removed from the product exit 36. This product is relatively cool (100° F. to 180° F.) and, therefore, requires minimal further cooling, if any, prior to storage or shipment. The level of drying can be controlled by varying solids residence time (fuel feed rate), oxygen-to-fuel ratio, or fluidizing gas flow rate, and inlet gas temperature.

Figure 2:
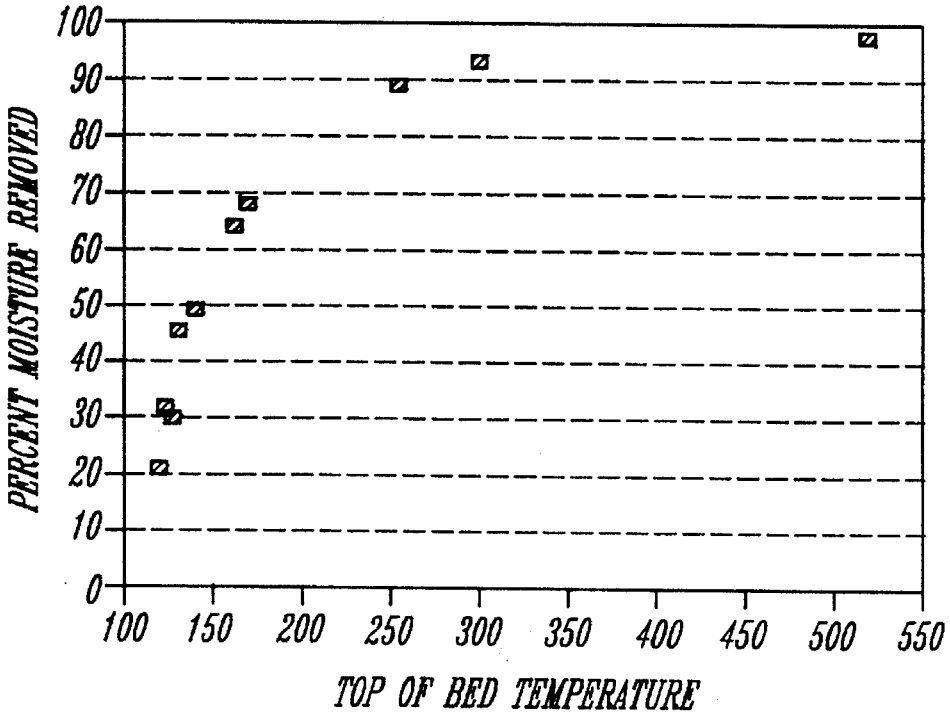
FIGS. 2–5 present data using a Western subbituminous coal in the reactor of the invention. In particular.

Drying tests were performed using lignitic and subbituminous coals. The temperature at the top of the bed is directly related to the amount of moisture removed. Moisture removals ranging from 20% to 100% were achieved at top of bed temperatures ranging from 120° F. to 550° F. Up to 70% moisture removal was achieved with top of the bed temperature as low as 170° F. Removal of surface moisture and some of the inherent moisture is accomplished at low temperatures; and, therefore, little or no cooling of the product is required after removal from the controlled spontaneous reactor. To achieve dryness relating to 80% to 100% moisture removal, relatively high temperatures are required (top of the bed temperatures 41 from 200° F. to 550° F.). In these cases, the product must be cooled prior to exposure to air to eliminate the potential for uncontrolled spontaneous combustion. The top of bed temperature is a function of the type of fuel and moisture level of the fuel, the inlet air temperature and quantity, fuel feed rate, and oxygen-to-fuel ratio. FIG. 2 presents data generated using a subbituminous coal.

In the drying mode, the fluidizing gas-to-fuel ratio has a major impact on the product quality. At a given temperature, increasing fluidizing gas throughput effectively increases the moisture-carrying capacity of the fluidizing gas, thereby producing a drier product material. Additionally, the breakup of fuel within the bed is enhanced with increased moisture removal. The final size of the dry product can be controlled by varying the size of the feedstock, the fluidizing velocity, residence time, and inlet temperature. In contrast to other types of thermal dryers, the use of low temperatures in this process is expected to produce only a minimal amount of fines. This process also can utilize a much larger feedstock size than other competing processes which has a major impact on the proportion of fines production.

The temperature of the incoming gas also has an effect on product drying and size reduction, but to a lesser extent. There was a significant increase in the amount of moisture removal from the feedstock as temperature increased, with a slightly greater degree of size reduction. This temperature is a combined effect of spontaneous heating and heat carried in with the fluidizing gas. This factor, coupled with the specifications of the end user, would be used to determine the size of a dryer for a specific application. In any case, the drying temperature would be maintained at a relatively low level compared to existing thermal dryers.

Fuel feed rate, which is related to particle residence time within the fluidized bed, also affects the product quality. Testing at the lower fuel feed rates (longer residence times) resulted in greater moisture removal and larger degree of size reduction.

The effect of oxygen-to-fuel ratio on drying and size reduction of the fuel feedstock showed no trend at those conditions resulting in a top of the bed temperature below 170° F. For those tests where operation was performed to obtain top of the bed temperatures above 250° F., increasing oxygen-to-fuel ratio resulted in increased drying and size reduction.

In the drying mode, the operation of the system is controlled primarily using gas velocity, fuel feed rate, and inlet gas temperature. This is in contrast to the devolatilization mode in which oxygen-to-fuel ratio is the primary control.

In the devolatilization mode, the temperature in the bed typically ranges from 700° F. to 1300° F. The exact temperature is a function of the amount of devolatilization desired, the quality of the gases desired, and the type of fuel being treated in the controlled spontaneous reactor. The reactor temperature 41 is a set point used to determine the nature of the product. All of the heat required to dry and devolatilize the coal is provided by controlled spontaneous combustion of a portion of the coal. Therefore, the gases 2 and 3 used to fluidize the controlled spontaneous reactor can be at ambient temperature. It is envisioned in most applications, however, that flue gas will be used as the main fluidizing gas to the controlled spontaneous reactor. Ambient air will also be added to the controlled spontaneous reactor to obtain the desired oxygen-to-fuel ratio to reach the desired level of volatiles release, at a specific gas velocity and fuel feed rate. The system can easily be controlled using oxygen-to-fuel ratio, gas velocity, and fuel feed rate (reflected by the gas-to-fuel ratio).

The oxygen-to-fuel ratio is the primary control mechanism when operating in this regime. Depending upon the properties of the feedstock, typical oxygen-to-fuel ratios range from 0.004 to 0.20 mole $O_2$ per mole carbon in the fuel to achieve up to 100% removal of the volatile matter in the fuel. The char yield and size are also functions of oxygen-to-fuel ratio, with the size and quantity of the product char decreasing as the oxygen-to-fuel ratio increases.

The fluidizing gas velocity and fuel feed rates are also important in determining the amount of volatile release.

Figure 3:
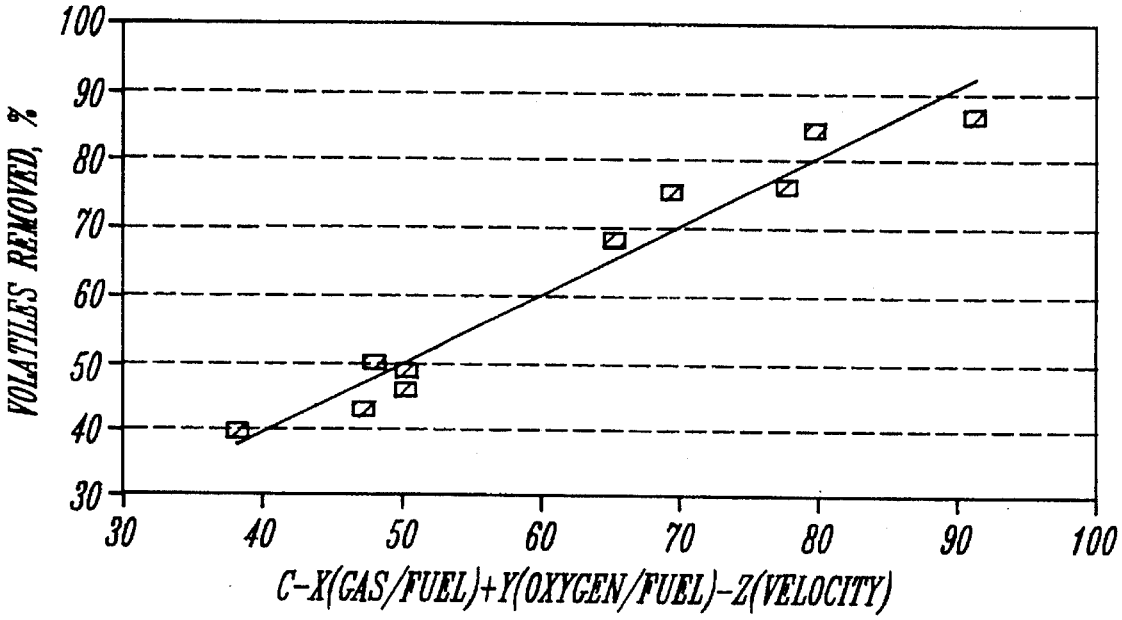

At a given oxygen-to-fuel ratio and operating temperature, the residence time (fuel feed rate) can be used to control the quantity of volatiles released from the fuel while the fluidizing gas velocity can be used to control the quality (heat content) of the product gases. Control of the amount of volatiles released is a function of the ratio of the total gas flow to the fuel feed rate. This relationship allows for the production of an offgas with a usable heat content. FIG. 3 shows the relationship between gas-to-fuel, oxygen-to-fuel, and fluidizing gas velocity on the amount of volatiles released.

Figure 4:
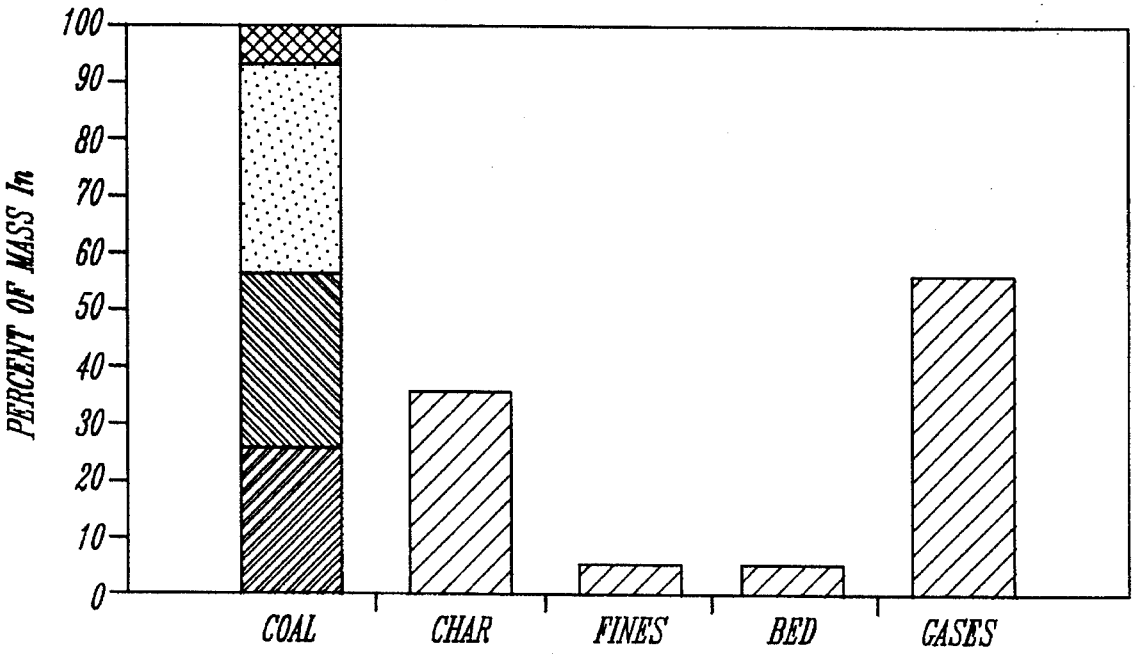
Figure 5:
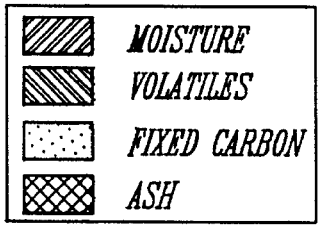
Figure 5:
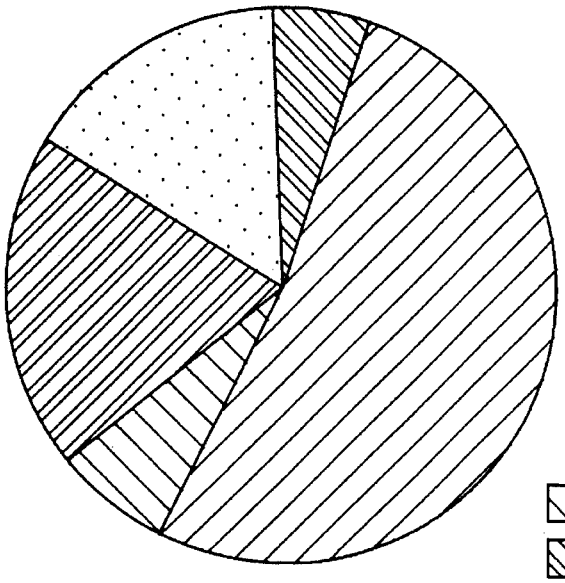
Figure 5:
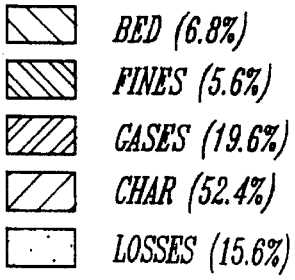

The heating value of the offgas from the controlled spontaneous reactor can be an important control point while operating in the devolatilization mode. The heating value of this gas is a function of the moisture and volatile levels of the original fuel and the oxygen-to-fuel ratio, fluidizing gas flow rate, and fuel feed rate used during operation. Product gases 7 evolved from the devolatizing with a heat content ranging from 50 to 150 Btu/scfm have been generated. Design of the system can be made to encourage the carry-over of coal fines which will further enhance the Btu content of the product gas stream. The amount of fines can be controlled with velocity, freeboard design, and the use of an optional cyclone 8. Typical mass and energy balances are given in FIGS. 4 and 5 for one specific case.

The final solid char product size is also a function of oxygen-to-fuel ratio, gas flow rate, and fuel feed rate. Product size decreases with an increase in oxygen-to-fuel ratio and a decrease in fluidizing gas velocity and fuel feed rate. The control parameter is a ratio of these quantities. The quality of this product char can therefore be controlled to produce a marketable char.

An important aspect of this invention is its general application to improve performance of a wide variety of existing technologies. The details of operation for several specific applications are illustrated below.

This device can be used to eliminate derates when firing high-moisture Western coals in a bituminous boiler. One of the main reasons for the derate when such a coal switch is made is because the high moisture in the low-rank coals reduces the capacity of the pulverizer. In this application, the controlled spontaneous reactor would be operated in the drying mode. Flue gas from the boiler would be used as the fluidization medium and would provide the heat for drying. The dried coal would be fed to the mills, while the exhaust gas containing the moisture that was removed can either be cleaned and vented up a stack or fed directly into the boiler.

In a cyclone boiler, this technique could also be used to improve the burner performance. The coal would be dried to the level necessary to obtain optimal temperatures in the cyclone. This process would enable the utilities using bituminous designed cyclone boilers to get back capacity lost due to the high moisture in the low-rank coals. The product from the controlled spontaneous reactor could be controlled to eliminate the final sizing of the coal that is currently necessary for cyclone burners.

A second application involves $NO_x$ reduction in cyclone-fired boilers. In this application, the controlled spontaneous reactor would be operated in the devolatilization mode. The coal would be dried and partially devolatilized in the controlled spontaneous reactor. The controlled spontaneous reactor could be designed so that the sized product char could be fed directly to the cyclone burners. The offgas would be piped to the upper part of the boiler and burned in a fashion similar to that utilized by natural gas reburn technology. The degree of devolatilization that would be performed in the controlled spontaneous reactor would be controlled to obtain the desired concentration of $NO_x$ at the outlet of the cyclone boiler.

A third application would extend the load control range of a fluidized-bed combustor. The controlled spontaneous reactor would be operated in a devolatilization mode. The offgas would be routed to the upper part of the combustor where the primary superheat surfaces are located. This offgas would be burned in the upper part of the combustor to raise the temperature in the upper part of the combustor during low load conditions. This would help maintain good steam quality during low load operation and extend the degree of turndown of the system.

A fourth application is a method to reduce $NO_x$ and $N_2O$ in fluidized-bed combustion. The controlled spontaneous reactor would be operated in a devolatilization mode. The offgas would be burned in the upper combustor chamber of a bubbling fluidized-bed combustor or in the main cyclone of a circulating fluidized-bed combustor. The level of devolatilization that would be performed in the controlled spontaneous reactor would be controlled to obtain the desired outlet concentration of $NO_x$ and $N_2O$ from fluidized-bed combustion. In this application, a sorbent such as limestone may be added to the controlled spontaneous reactor to act as an agent to capture sulfur that is present in the coal. This sorbent would be removed with the product char and included as feed to the fluidized-bed combustor.

A fifth application is an inexpensive method for the production of char. In this mode of operations, the system would be operated in the devolatilization mode. The offgas would be collected and burned for heat recovery in an existing boiler or one specifically added for this purpose. The char product would be removed and cooled.

A sixth application is a new type of coal dryer. For this application, the controlled spontaneous reactor would be operated in the drying mode. The optional cyclone would most likely be used for this application. A baghouse or other particulate removal device would be used to clean the moisture-laden offgas vented to the atmosphere. The dried product would require minimal or no additional cooling since it will be removed from the controlled spontaneous reactor at temperatures ranging from 100° F. to 180° F. The solids residence time, rather than the temperature, would be used to control the dryness of the product. This feature, along with the ability to process larger-sized feedstocks, differs from conventional thermal dryers and is one of the major advantages of the controlled spontaneous reactor when used as a dryer.

Some of the general advantages of this system will be apparent to those skilled in the art. Minimal coal preparation will be required. Both fines and large coal particles can be efficiently handled. A large amount of coal can be processed in a relatively small volume. Therefore, the unit will be small and will be very well-suited for modular construction and shop fabrication. The unit will be retrofittable to existing units because of its small size and minimal requirements for auxiliary systems. In the devolatilization mode of operation, the unit will be self-sustaining-will operate without auxiliary heat. The system will be able to generate a sized product while generating only a minimal amount of fines.

There are also specific advantages, depending upon the application. A major advantage when used to eliminate derates when switching coals is that a utility could maintain boiler capacity without expensive modifications to the boiler. When used in a cyclone burner to control $NO_x$, the reduced moisture content to the burner would improve cyclone performance, and the high moisture content in the upper combustor would reduce fouling by lowering the furnace exit gas temperature.

When used to extend load control and control $NO_x$ and $N_2O$ in fluidized-bed combustion, a reduction in total equipment would result, since the controlled spontaneous reactor would be smaller and less expensive than the coal sizing equipment it would replace. Fuel flexibility would increase by "equalizing" the fuel that is fed directly into the combustor in terms of moisture and volatile content. Staging of the air and fuel will result in a lower air requirement for the fluidized bed combustor (1.1 vs. 1.2 air-to-fuel ratio). The physical size of the fluidized bed combustor could be reduced when the controlled spontaneous reactor is used.

When used as a coal dryer, the low top of bed temperature means little or no cooling of the dried product is required. Low gas temperatures are required so that low-grade waste heat can be used for drying. The physical design of the controlled spontaneous reactor allows the dryer to be used to size the coal. Residence time can be used to control the degree of dryness. Temperature can also be used to control the amount of drying; however, the controlled spontaneous reactor can get varying degree of dryness at the same temperature, which differs from conventional dryers.

In summary, it can be seen that the present invention allows a controlled spontaneous reactor to perform a variety of operations, depending upon the ultimate end use for the products. As a result, the applications of a given low-rank coal can be expanded, without the need for substantial individual expenditures of capital funds and operating costs, to tailor treatment for specific uses. A substantial savings is therefore achieved.

What is claimed is:

1. A process of improving overall quality in coals comprising heat treating low-rank coals in a controlled spontaneous fluidized bed reactor zone comprising:

introducing raw coal feed and fluidized gas in a reactor, said reactor having a top portion and a bottom portion and a smaller cross sectional area at said bottom portion than at the top portion wherein the bottom portion is divided into multiple plenum chambers;

treating the raw coal feed with a mixture of air and fluidizing gas wherein the mixture is fed into the reactor through the plenum chambers, and further providing that the velocity of the fluidizing mixture is substantially higher at the bottom portion of the reactor than the top portion of the reactor, wherein the treated coal progressively rises from the bottom portion of the reactor to the top portion of the reactor as the coal becomes smaller in size;

withdrawing the treated low-rank coal from the top portion of the reactor;

wherein the size of the treated coal is controlled by using variable velocity, temperature of the inlet gas, oxygen-to-fuel ratio, fuel feed rate, and reactor design.

2. A process of improving overall quality in coals comprising heat treating low-rank coals in a controlled spontaneous fluidized bed reactor zone by introducing raw coal feed and fluidized gas in a reactor:

said zone having a top portion and a bottom portion and a smaller cross sectional area at said bottom portion than at said top portion with said bottom portion being divided into multiple plenum chambers;

inlet means for introducing a mixture of air and fluidizing gas near the bottom of said zone;

coal inlet means for introducing size reduced low-rank coal above the bottom of said zone but between the bottom and top of said zone;

an overflow exit for withdrawing treated low-rank coal located between said bottom portion and said top portion; and an offgas exit located adjacent said top portion, the velocity of fluidized material being substantially higher at the bottom of said zone than at the top of said bed;

wherein the temperature of the fluidizing gas/coal mixture is within the range of from 100° F. to 1300° F.

3. A process of improving overall quality in coals comprising heat treating low-rank coals in a controlled spontaneous fluidized bed reactor zone by introducing raw coal particles and fluidized gas in a reactor to generate a char product and fines:

said zone having a top portion and a bottom portion and a smaller cross sectional area at said bottom portion than at said top portion with said bottom portion being divided into multiple plenum chambers;

inlet means for introducing a mixture of air and fluidizing gas near the bottom of said zone;

coal inlet means for introducing size reduced low-rank coal above the bottom and top of said zone;

an overflow exit for withdrawing treated low-rank coal located between said bottom portion and said top portion; and an offgas exit located adjacent said top portion, the velocity of fluidized material being substantially higher at the bottom of said zone than at the top of said bed;

wherein the average fluidizing gas velocity at top of said zone in the said reactor zone can range from 3 ft/sec. to 20 ft/sec. and the local fluidizing gas velocities in selected regions of the lower portion of said reactor zone will range from 1 to 5 times the minimum fluidization velocity of the largest coal particle to be resident within each of the said fluidizing gas regions.

4. The process of claim 3 which is a drying process.

5. The process of claim 3 which is a devolatilization process.

6. The process of claims 4 or 5 wherein the solid fuel size is 4 inch or less.

7. The process of claim 4 wherein the temperature of the fluidizing gas/solids mixture is within the range of from 100° to 800° F.

8. The process of claim 5 wherein the temperature of the fluidizing gas/solids mixture is within the range of from 700° F. to 1300° F.

9. The process of claim 3 wherein the oxygen-to-fuel ratio is from 0.004 to 0.2 moles $O_2$ per mole carbon in the fuel.

10. The process of claim 3 where the size of the char product is controlled by using variable velocity, temperature of the inlet gas, oxygen-to-fuel ratio, and fuel feed rate.

11. The process of claim 3 where the amount of fines generated is controlled by using variable velocity, temperature of the inlet gas, oxygen-to-fuel ratio, fuel feed rate, and reactor design.

12. The process of claim 3 where the devolatilization process is controlled using oxygen-to-fuel, total gas-to-fuel, reactor temperature and velocity.

13. The process of claim 5 where all of the heat required to devolatilize the fuel is produced by controlled spontaneous heating of the fuel.

14. The process of claim 3 where the fines generated during the process are removed either with the char, with the offgas, or separately.

15. The process of claim 5 where the controlled spontaneous reactor is used to produce a reburn fuel for $NO_x$ control in cyclone-fired boilers.

16. The process of claim 4 where the controlled spontaneous reactor is used as a fuel conditioner to regain unit capacity in bituminous units switching to low-rank coals.

17. The process of claim 4 where the controlled spontaneous reactor is used as a fuel conditioner to improve low-rank coal accommodation in cyclone-fired boilers designed for bituminous coals.

18. The process of claim 5 where the controlled spontaneous reactor is used as a fuel conditioner for all types of fluidized bed combustors to increase capacity, provide greater fuel flexibility, and improve turndown, start-up and shutdown characteristics, and control $N_2O$ and $NO_x$.

19. The process of claim 5 where the controlled spontaneous reactor is used to produce char.

* * * * *